United States Patent [19]

Purr et al.

[11] 4,295,913

[45] Oct. 20, 1981

[54] ELECTRICALLY OPERATED DEVICE, ESPECIALLY DUPLICATING DEVICE, WITH A RECEPTACLE TO ACCOMMODATE FLUID FOR THE CHEMICAL TREATMENT OF OBJECTS

[75] Inventors: Horst Purr, Tennenbronn; Manfred Kistler, Eisenbach; Rolf Müller, St. Georgen, all of Fed. Rep. of Germany

[73] Assignee: Mathias Bauerle GmbH, Georgen, Fed. Rep. of Germany

[21] Appl. No.: 125,666

[22] Filed: Feb. 28, 1980

[30] Foreign Application Priority Data

Mar. 3, 1979 [DE] Fed. Rep. of Germany ..... 2908283

[51] Int. Cl.[3] ..... B41C 1/10

[52] U.S. Cl. ..... 156/345; 118/603; 118/694; 134/57 R; 137/391; 137/392; 137/563; 156/642; 354/324; 417/36

[58] Field of Search ..... 118/694, 602, 603; 156/345, 626, 627, 642; 137/391, 563, 392; 354/298, 324; 134/57 R; 417/36

[56] References Cited

U.S. PATENT DOCUMENTS

| | | | |
|---|---|---|---|
| 3,259,557 | 7/1966 | Smith et al. | 118/429 X |
| 3,841,351 | 10/1974 | Shida | 354/324 X |
| 3,850,136 | 11/1974 | Ruzzo | 118/694 X |
| 3,937,083 | 2/1976 | Sabatino | 137/391 X |
| 3,973,961 | 8/1976 | Stroszynski | 118/603 X |
| 3,983,837 | 10/1976 | Francis | 118/694 |
| 4,042,444 | 8/1977 | Snyder | 137/391 X |

*Primary Examiner*—Willam A. Powell
*Assistant Examiner*—Thomas E. Bokan
*Attorney, Agent, or Firm*—Craig and Antonelli

[57] ABSTRACT

An electrically operated device such as a duplicating machine has a recptacle for accommodating a fluid for the chemical treatment of sheet material and like objects. The receptacle may be in the form of a dip tank designed for passing sheet material therethrough. This dip tank is connected via a supply conduit to a storage tank and the supply conduit includes a pump controlled by an automatic charging and metering unit for supplying fluid to the dip tank. A drain conduit leading to the storage tank is connected to the dip tank. This drain conduit includes a solenoid valve for stopping or allowing the flow of fluid through the drain conduit.

15 Claims, 4 Drawing Figures

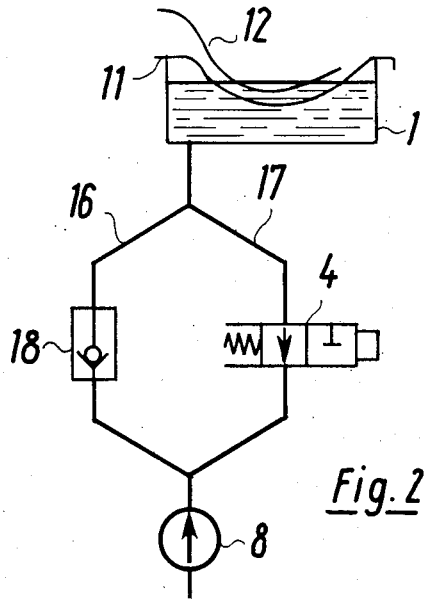
Fig. 2
Fig. 3
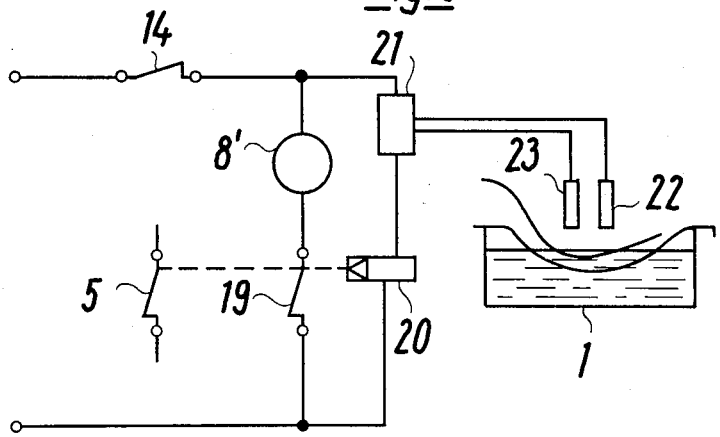

ELECTRICALLY OPERATED DEVICE, ESPECIALLY DUPLICATING DEVICE, WITH A RECEPTACLE TO ACCOMMODATE FLUID FOR THE CHEMICAL TREATMENT OF OBJECTS

The invention relates to an electrically operated device with a receptacle to accommodate fluid for the chemical treatment of objects, especially a duplicating device, with a dip tank designed for passing sheet material therethrough, this dip tank being connected via a supply conduit to a storage tank, and the supply conduit including a pump controlled by way of an automatic charging and metering unit.

In offset printers and also in other devices, means are provided, with the aid of which an offset film or the like, for example, is chemically pretreated with a special fluid, i.e. is subjected to a special etching process. In photoengraving devices, the exposed paper is aftertreated, for example, in a similar manner by means of a fluid. The fluids utilized for these devices, especially the etching fluid, frequently exhibit the disadvantage that they are altered upon contact with air, for example the fluids are oxidized, crystallized, thickened, or the like. Besides, there is the danger that these fluids are contaminated by the dust contained in the air and by other impurities. Therefore, the operator of such devices must take care that the device, after a relatively long period of idleness, is placed in operation in such a condition that perfect functioning is ensured.

In offset printers, it is customary after a rather long inoperative period of the offset printer to empty the fluid, especially the etching fluid, from a more or less open tank prior to resuming operation of the device. After cleaning the tank, the tank is filled with new fluid. This step substantially reduces the operating efficiency. Especially, in case of devices which otherwise work fully automatically, such a procedure is extremely troublesome.

To avoid the aforementioned difficulties, it has been known to pump the etching fluid of an offset printer during operation continuously into the dip tank and simultaneously to allow the fluid to run from the dip tank back into a storage tank by way of a drain conduit. Once the device is switched off, the pump is likewise inoperative, so that the etching fluid returns completely into the storage tank. This constant circulation of the fluid, requiring a continuous running of the pump, proves to be disadvantageous under practical conditions, because the contact of the fluid with air and also with the objects to be treated is substantially increased so that the thus-affected surface area of the fluid is also enlarged. This has a disadvantageous influence on the quality of the fluid. Even additionally provided filters cannot constitute a remedy in this type of construction, especially if the fluid tends to crystallize.

This invention is based on the object of increasing the operating efficiency in a device of the type heretofore described, and of ensuring that an operator need not ascertain the quality of the treatment fluid even if the device is turned on again after a relatively long idle period. In this connection, the quality of the treatment fluid in its entirety is not to be impaired.

This object has been attained by connecting to the receptacle a drain conduit that leads back to the storage tank and that includes a solenoid valve.

By means of this construction, it becomes possible to drain the fluid from the receptacle when the device is turned off and a relatively long idle period is to be expected, and to return the fluid into the storage tank. By the simultaneous utilization of a charging and metering unit, it is ensured that the pump need not operate continuously. Also, no continuous circulation of the fluid is required.

In an especially advantageous embodiment of the invention the provision is made that the solenoid valve, which closes in the excited or actuated condition, is connected to the current supply of the electrically operated device. This has the result that the operator, when shutting off the device, need not give any special attention to the problem of the fluid and of fluid return, since with the interruption of the current supply to the device, the solenoid valve opens up and closes again after the current has been turned on. It is also possible to provide for the solenoid valve, which closes in the excited condition, an on/off switch preferably arranged in a control panel of the device. This on/off switch need not separate the entire device from the current mains, i.e. current supply but need merely cut off the solenoid valve and, for example, several other parts of the device from the current supply.

In a further embodiment of the invention, the provision is made to arrange a further switch in the electrical line leading to the solenoid valve, this further switch being connected to a timer unit and/or to a counter determining the number of treatments. Since the fluid, during constant use of the device, is partially consumed and also absorbs impurities, it may be desirable to completely renew this fluid from time to time, so that the quality of the chemical treatment is not impaired. This can be controlled depending on the time or on the number of treatments.

Another embodiment of the invention provides that the charging and metering unit includes a switch responsive to the level of the fluid in the receptacle for controlling the activation of the pump. In a suitable arrangement, the switch controlling the activation of the pump consists of two electrodes immersed in the fluid upon reaching the desired level. In this connection, use is made of the fact that especially in offset printers the fluids employed exhibit varying resistances with respect to the air.

In a further development of the invention, the provision is made that another switch responsive to the fluid and serving as a safety switch is arranged above the desired level of the receptacle. This switch becomes operative if, for example, the switch controlling the drive of the pump continues to convey fluid. This safety switch prevents overflowing of the receptacle and entrance of treatment fluid into the device.

Additional features and advantages of the invention can be seen from the following description of the embodiments illustrated in the drawings.

FIG. 2 shows a combined feed and drain conduit.

FIG. 3 shows a circuit arrangement for a safety limit switch, and

Figure 1:
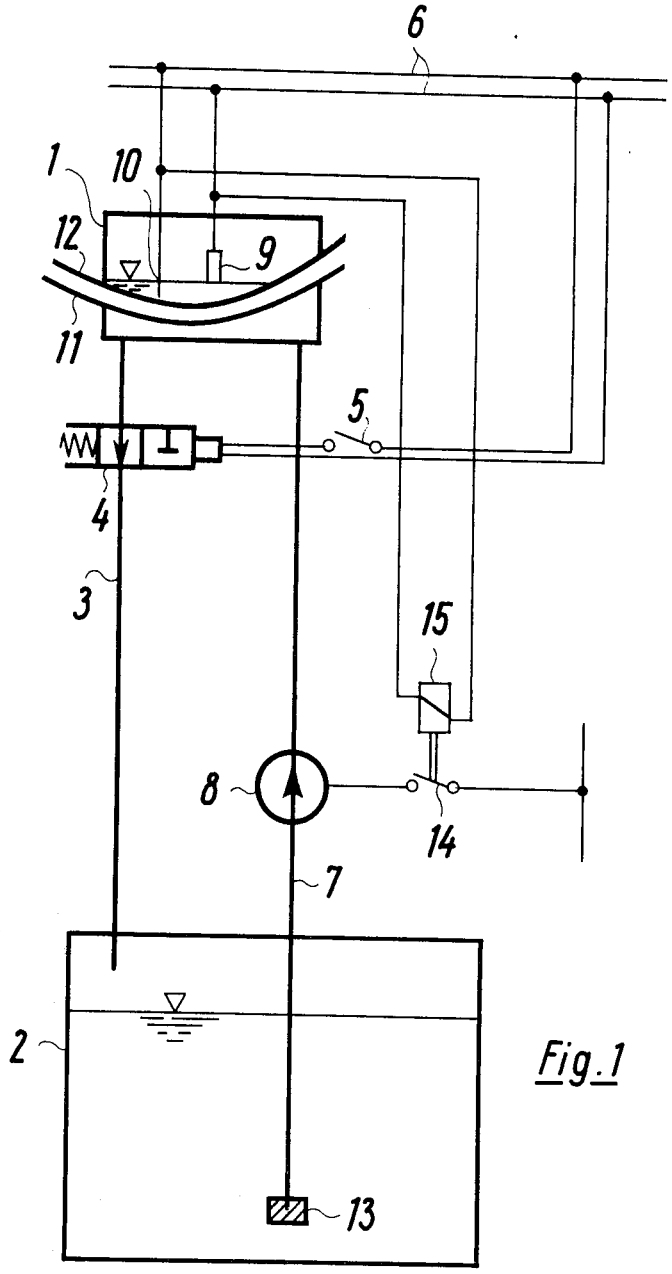
FIG. 1 is a schematic view of a dip tank of an electrically operated device for etching of sheet material with a fluid and a storage tank with the elements provided for the feeding and discharging of the fluid.

The drawing shows a receptacle or dip tank 1, serving, for instance, for the etching of offset printing films or sheets. This receptacle 1 is filled with an etching fluid for chemically treating the offset printing films, which films are guided through the receptacle and are thereby immersed in the fluid. The receptacle is provided with two curved guide surfaces 11 and 12 immersed within the receptacle 1 underneath the level of the fluid. Perforated guide surfaces 11 and 12 can be provided, or guide surfaces leaving a sufficient margin laterally of the receptacle so that the fluid can enter to a sufficient extent into the gap between the guide surfaces. The receptacle 1 is associated with a closed storage tank 2, which is substantially larger and is arranged at a level below the bottom of the receptacle 1. This storage tank is connected to the receptacle 1 by way of a supply conduit 7. Within the supply conduit 7, a pump means 8 is arranged for pumping the fluid from the storage tank 2 into the receptacle 1 by way of the lower portion of the supply conduit which dips into the tank 2. This portion of the supply conduit extends approximately down to the bottom and being provided with a filter 13.

The quantity of fluid pumped into the receptacle 1 is controlled by a charging and metering unit. This charging and metering unit consists of two electrodes 9 and 10 serving as the switch for a relay 15, the relay activating a switch 14 establishing the current supply to the drive mechanism of the pump 8. Upon the immersion of both electrodes 9 and 10 in the fluid (which is conductive), the relay 15 is excited so that the switch 14 is opened and current supply to the pump 8 is interrupted.

The electrodes 9 and 10 are supplied with direct current from a source forming a part of the control current circuit. To prevent the overly rapid consumption of one of the electrodes 9 or 10 and/or an electrolytic change of the fluid, the provision can be made to apply voltage to the electrodes only cyclically. This can be attained in the simplest case by half-wave rectification of an alternating current voltage. In this case, a correspondingly different circuit is provided for the drive mechanism of the pump 8, designed for this cyclical interrogation of the level.

The receptcle 1 is also connected to the storage tank 2 via a drain conduit 3 beginning on the bottom of the receptacle 1 and leading to the storage tank 2 disposed therebelow, so that the receptacle 1 can be completely drained via the drain conduit 3. A solenoid valve 4 is arranged in the drain conduit, this valve either closing or opening the fluid flow in the drain conduit. The solenoid valve 4 is switched so that it blocks or closes the drain conduit in the excited condition and vacates or opens the drain conduit in the unexcited condition. For this purpose, the solenoid valve 4 is connected via a switch 5 to the current supply 6 in such a way that, when the switch 5 is open, the solenoid valve assumes its illustrated position so that the etching fluid can be completely drained from the receptacle. The switch 5, designed as an on/off switch, can also be omitted if a main switch to be operated normally when the device is shut off is provided to cut off the device operatively associated with receptacle 1 from the current mains, since in such a case the solenoid valve 4 likewise is without current and blocks the drain conduit 3 only upon a reactivation of the device. It is also possible to directly supply the solenoid valve 4 with the mains voltage, for example by way of a main switch, and to provide for this purpose, for instance, a separate contact in the contact bank of the main switch relay or the main contactor.

Upon a reactivation of the device, the switch 5 is closed so that the solenoid valve 4 is excited and assumes the position in which it blocks the drain conduit leading from the receptacle 1. Since in such a case the electrodes 9 and 10 indicate that fluid is missing, the relay 15 is not excited so that the switch 14 is closed and the pump 8 is running. As soon as the level has risen to such an extent that both electrodes are immersed in the fluid, the relay 15 is activated and the switch 14 is opened so that in this case the pump drive mechanism is made inoperative.

The electrode 10 is fixedly arranged in the receptacle so that it dips into the fluid along a predetermined portion of its length. In contrast thereto, the electrode 9 is arranged to be vertically adjustable at the receptacle in a manner not shown in detail, so that by its adjustment the fluid level can be set.

To prevent overfilling of the receptacle 1, another level switch is provided as a so-called safety switch; this switch, when the normal level has been exceeded up to a predetermined safety level, interrupts the drive mechanism 8' of the pump and causes the switch 5 of the solenoid valve 4 to open as shown in FIG. 3. The switch 5 of the solenoid valve and the switch 19 of the drive mechanism 8' of the pump are controlled by way of a relay 20 actuated by an electronic switching means 21, associated with two sensor electrodes 22 and 23 aligned with respect to the safety level. With the provision of the sensor electrodes 22 and 23 and the electronic control unit 21, the differing resistances between the fluid accommodated by the dip tank 1 and the air are utilized. The condition "sensor in fluid" is evaluated as a logic one in the electronic circuit. Thus, the level of any fluid can be monitored, the electric resistance of which differs markedly from the electric resistance of the air. The two electrodes 22 and 23 and the electronic control 21 could be replaced by a float switch similarly connected, which switch operates in the same way as a safety switch and is designed for the elevated level.

It is readily possible to provide circuits other than those illustrated in FIGS. 1 and 3 for monitoring the level and for the safety governing function. In particular, it can be advantageous to provide the electronic circuit (FIG. 3) for normal-level monitoring, and to arrange the relay circuit (FIG. 1) for safety evaluation, since in such a case an error in the electronic unit could lead to a disturbance in the operation, but could not result in overfilling. However, in all instances it is expedient to design the two switching circuits differently to obtain a genuine control redundancy.

In the embodiment of FIG. 2 a combined supply and drain conduit is provided between the dip tank 1 and the storage tank 2, (not shown); this conduit, starting from the storage tank 2, is subdivided after the pump 8, into two branches 16 and 17 extending in parallel to each other and being recombined prior to being connected to the underside of the dip tank 1. The branch 16 contains a back-run safety mechanism or one-way flow valve 18 excluding a drainage of fluid by way of this branch 16. The branch 17 includes the solenoid valve 4 which can be connected in accordance with the arrangement of FIG. 1 and/or FIG. 3. By means of this construction, the feature is provided that, after the device has been turned on and the pump has then been immediately activated, fluid is also initially pumped with a certain amount of pressure through the solenoid valve 4 until the latter is closed. The time period of this throughflow of fluid conveyed under the pressure of the pump is actually very brief, but is sufficient to detach or dissolve any deposits which may be present in the zone of the solenoid valve, especially crystals. The arrangement of FIG. 2 is advantageous, in particular, in connection with the solenoid valve 4 illustrated in FIG. 4, wherein the provision is made that the closing motion of the solenoid valve 4 is enhanced by the fluid conveyed by the pump. It is thus possible to make do with a relatively weak magnet in the solenoid and to obtain an adequately secure functioning.

Figure 4:
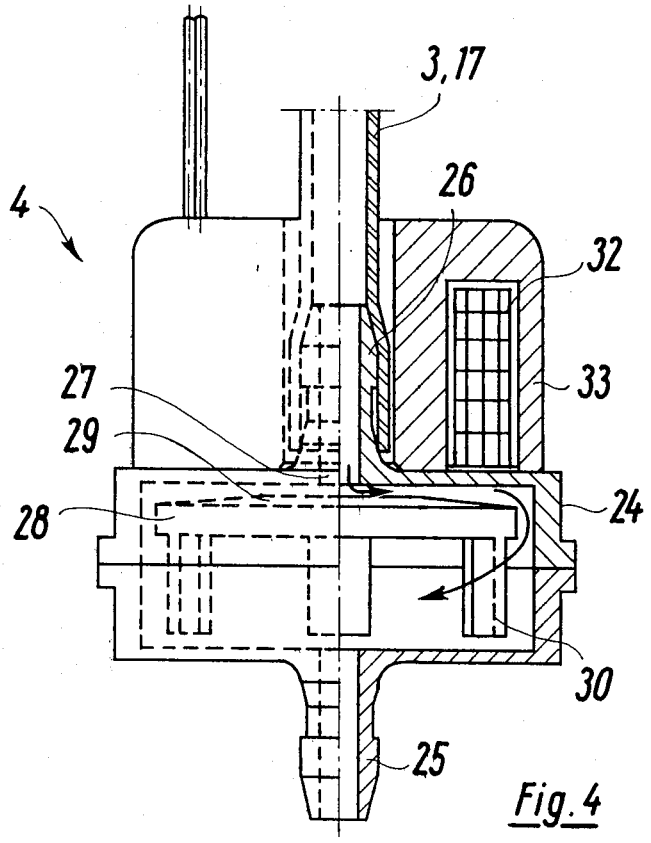
FIG. 4 shows a simple arrangement for a solenoid valve located in the drain conduit.

The solenoid valve 4 depicted in FIG. 4 has a bipartite housing 24 divided in a horizontal plane of symmetry; this housing can be made preferably of a synthetic resin. On the topside and bottom side of this housing, connections 25 and 26 are located which are fashioned as hose sockets over which corresponding parts of the drain conduit 3 or the branch 17 of the combined supply and drain conduit are placed; these conduits are constructed as hoses, e.g. rubber hoses. Within the housing 24 a sealing disk 28 is arranged which seals off the orifice 27 leading into the interior of the housing 24; this sealing disk has a sealing surface 29 facing the orifice 27. The sealing disk 28 is guided with axial extensions 30 in the bottom part of the housing. The sealing disk 28 is fashioned as a metallic armature disk associated with a winding 32 located outside of the housing 24 which surrounds the connection 26. The winding 32 is accommodated in a housing 33. With this construction, only the sealing and armature disk 28 as well as the interior of housing 24 come into contact with the fluid. The sealing action of the solenoid valve 4 of FIG. 4 depends on the lifting force of the magnet. Since generally there are no appreciable pressure differences in copying devices and also in offset printers, dependent on the difference in level between the dip tank 1 and the solenoid valve 4, the sealing action provided by the magnetic force entirely satisfies the posed requirements under practical conditions.

What is claimed is:

1. An electrically operated offset printer including means for etching offset printing films, said means for etching comprising a dip tank having means for passing said offset printing films therethrough, a storage tank for storing the etching fluid, a supply conduit connecting said dip tank and said storage tank for passing etching fluid from said storage tank to said dip tank, pump means for causing etching fluid to pass from said storage tank to said dip tank, an automatic charging and metering unit for controlling said pump means to pump etching fluid into said dip tank when the fluid level in the dip tank is below a predetermined level, and a drain conduit, connecting the storage tank with the dip tank, for draining the etching fluid from the dip tank, said drain conduit including a solenoid valve which is adapted to be opened for draining the etching fluid from the dip tank, whereby the dip tank can be drained when the printer is turned off and the dip tank will be filled to operating level when the printer is operated, without continuous operation of said pump means.

2. A printer according to claim 1, characterized in that the solenoid valve, which closes in the electrically energized condition, is connected to the current supply for the printer and is switched together therewith, whereby when the printer is off the solenoid valve is open, to drain said dip tank.

3. A printer according to claim 1 or 2, characterized in that an on/off switch is provided for the solenoid valve, which valve closes in the energized condition.

4. A printer according to claim 2, characterized in that a further switch is arranged in an electrical line leading to the solenoid valve, said further switch being connected to a timer unit and/or a counter detecting the number of treatments of the printing films within said dip tank.

5. A printer according to one of claims 1 or 2, characterized in that the charging and metering unit includes a switch means responsive to the level of the fluid in the dip tank for controlling a drive mechanism of the pump.

6. A printer according to claim 5, characterized in that the switch means controlling the drive mechanism of the pump includes two electrodes adapted to be immersed in the fluid when the desired level has been reached within the dip tank.

7. A printer according to claim 6, characterized in that a further switch is arranged above the desired level of the dip tank, this switch being responsive to the presence of fluid and serving as a safety switch.

8. A printer according to claim 6, characterized in that the safety switch is arranged as an interrupter in the drive mechanism of the pump.

9. A printer according to claim 6, characterized in that the safety switch is arranged as an interrupter in the current supply to the solenoid valve, whereby said valve is opened when said current supply is interrupted.

10. A printer according to one of claims 1 and 2, characterized in that a combined supply and drain conduit is provided between the dip tank and the storage tank, this conduit having two branches in the conveying direction downstream of the pump, one branch containing the solenoid valve and the other containing a back-run safety mechanism.

11. A printer according to one of claims 1 and 2, characterized in that the solenoid valve has a housing provided with two connections for the upper and lower portion of the drain conduit, this housing containing an armature disk, which disk is associated with one of the connections and is coordinated with an electrical winding arranged outside of the housing.

12. A printer according to claim 1, characterized in that said storage tank is closed.

13. A printer according to claim 1, wherein said means for passing said printing films therethrough comprises curved guide surfaces adapted to be underneath the level of the fluid in said dip tank, said curved guide surfaces being adapted to have fluid pass in the gap between them.

14. A printer according to claim 3, characterized in that said on/off switch is positioned in a control panel for controlling said printer.

15. A printer according to claim 3, characterized in that a further switch is arranged in an electrical line leading to the solenoid valve, said further switch being connected to a timer unit and/or a counter detecting the number of treatments of the printing films within said dip tank.

* * * * *